US005650266A

United States Patent [19]

Taguchi et al.

[11] Patent Number: 5,650,266

[45] Date of Patent: Jul. 22, 1997

[54] SILVER HALIDE PHOTOGRAPHIC EMULSION AND SILVER HALIDE PHOTOGRAPHIC LIGHT SENSITIVE MATERIAL

[75] Inventors: Kumiko Taguchi; Tomoyuki Nakayama; Syoji Matsuzaka; Fumie Fukazawa, all of Hino, Japan

[73] Assignee: Konica Corporation, Japan

[21] Appl. No.: 594,746

[22] Filed: Jan. 31, 1996

[30] Foreign Application Priority Data

Feb. 6, 1995 [JP] Japan ..... 7-018054

[51] Int. Cl.[6] ..... G03C 1/005; G03C 1/035; G03C 1/08

[52] U.S. Cl. ..... 430/567; 430/569; 430/603

[58] Field of Search ..... 430/567, 569, 430/603

[56] References Cited

U.S. PATENT DOCUMENTS

| | | | |
|---|---|---|---|
| 4,806,461 | 2/1989 | Ikeda et al. | 430/567 |
| 4,835,095 | 5/1989 | Ohashi et al. | 430/567 |
| 4,945,037 | 7/1990 | Saitou | 430/567 |
| 5,061,614 | 10/1991 | Takada et al. | 430/569 |
| 5,087,555 | 2/1992 | Saitou | 430/567 |
| 5,244,781 | 9/1993 | Takada | 430/567 |
| 5,418,124 | 5/1995 | Suga et al. | 430/567 |

FOREIGN PATENT DOCUMENTS

| | | |
|---|---|---|
| 0282896 | 9/1988 | European Pat. Off. . |
| 0348934 | 1/1990 | European Pat. Off. . |
| 0562476 | 9/1993 | European Pat. Off. . |
| 3-189642 | 8/1991 | Japan . |
| 4-355748 | 12/1992 | Japan . |

OTHER PUBLICATIONS

Copy of 91–2854929 Derwent Publ. Fuji Photo Film Co., Ltd. (1 pg.).

Copy of 93–030195 Derwent Publ. Fugi Photo Film Co., Ltd. (1 pg.).

*Primary Examiner*—Mark F. Huff

*Attorney, Agent, or Firm*—Jordan B. Bierman; Bierman, Muserlian and Lucas LLP

[57] ABSTRACT

A silver halide photographic emulsion is disclosed, containing tabular silver halide grains each comprising plural silver halide phases different in a silver iodide content from each other, in which a highest silver iodide containing phase has a silver iodide content of not less than 5 mol % and less than 15 mol %, and a lower silver iodide containing phase is present outside and contiguous to the highest silver iodide containing phase; the tabular grains having 5 or more dislocation lines per grain and accounting for not less than 30% by number of total silver halide grains, the tabular grains further having a hole trap zone within the grain.

13 Claims, No Drawings

SILVER HALIDE PHOTOGRAPHIC EMULSION AND SILVER HALIDE PHOTOGRAPHIC LIGHT SENSITIVE MATERIAL

FIELD OF THE INVENTION

The present invention relates in general to a silver halide photographic emulsion and in particular to a silver halide photographic emulsion improved in sensitivity, resistance to pressure desensitization, latent image stability and low intensity reciprocity law failure.

BACKGROUND OF THE INVENTION

As a technique in silver halide grains for achieving high sharpness, it is known to design silver halide grains so as to shift the thickness in the direction of light penetration from a light scattering length to reduce light scattering due to the silver halide grains which deteriorate sharpness. In this case, it is necessary to design the thickness of the grain which causes light scattering so as to be shifted to thinner. Accordingly, silver halide grains in such a form as octahedron or cube become smaller in size thereof so that a light-intercepting efficiency of the grain is lowered, resulting in reduction in the sensitivity. It is well known that tabular grains are used as a technique for solving this problem.

It is also known to introduce a high iodide containing core within the grain so as to enhance a quantum yield of silver halide grains. There is disclosed tabular grains comprising a high iodide containing core in JP-A 63-92942 (the term, "JP-A" refers to an "published Japanese patent application).

However, it was found that the grains comprising high iodide core suffered from the defect that they were remarkable in pressure desensitization. The pressure desensitization can be improved by decreasing an iodide content of the high iodide core but it leads to lower the sensitivity, so that it cannot be put to practical use. Further, there is a tendency for the tabular grains to be inferior in pressure resistance owing to the form thereof. Accordingly, there has been desired development of a silver halide emulsion with little light scattering, high sensitivity and improved in pressure desensitization.

There is disclosed in JP-A 62-58237 a technique for improvement of fogging by pressure of silver halide grains, in which, during the course of formation of silver halide grains, iodide ions are rapidly added to the reaction mixture to localize a high iodide within the grain. There is also disclosed in JP-A 3-237450 and 4-350850 a method for improving the pressure fogging of the tabular grains in a similar manner to the above-described method. As apparent these disclosure, internally localized dislocation lines, silver iodide or high iodide containing phase results in an improvement in the pressure fogging.

On the other hand, from the viewpoint of preventing recombination of a free electron and hole which has been considered to be one of inefficiency factors relating to the sensitivity of a silver halide emulsion, it has been known in the art that reduction sensitization is effective in enhancing the sensitivity.

As described in Journal of Photographic Science, Vol. 25, page 19–27 (1979) and Photographic Science and Engineering Vol. 23, page 113–117 (1979), an optimally reduction-sensitized nucleus (speck) contributes to the sensitization according to the following reaction upon exposure to light, as mentioned by Mithell and Lowe in Photographishe Korrespondenz Vol. 1, page 20 (1957) and Photographic Science and Engineering Vol.19, page 49–55 (1975).

$$AgX+h\nu \rightarrow e^- + h^+ \quad (1)$$

$$Ag_2+h^+ \rightarrow Ag^+ + Ag \quad (2)$$

$$Ag \rightarrow Ag^+ + e^- \quad (3)$$

In the above, $h^+$ and $e^-$ represent a free electron and hole produced on exposure to light, h ν represents a photon and $Ag_2$ represents a reduction sensitization speck. Assuming that this mechanism is reasonable, the reduction sensitization nucleus is considered to prevent efficiency-lowering due to the recombination of the electron with the hole and therefore contribute to an increase in sensitivity.

According to Photographic Science and Engineering Vol. 16, page 35–42 (1971) and ibid Vol. 23 page 113–117 (1979), however, the reduction sensitization nucleus is able to trap not only hole but also electron so that a sufficient explanation cannot be provided based on the above mechanism alone.

Unlike a sensitivity speck inherent to silver halide grains described so far, it is dificult to predict a role of the reduction sensitization nucleus in a spectral sensitization region of specral-sensitized silver halide grains because of the latent image forming process thereof being complex.

In a silver halide emulsion spectrally sensitized, unlike an inherent sensitivity region, a sensitizing dye itself absorbs light and therefore the primary process of latent image formation is represented by the following (4) in place of (1) afore-described.

$$Dye+h\nu \rightarrow Dye^+ + e^- \quad (4)$$

Whether a dye hole ($Dye^+$) and electron ($e^-$) represented in the right-hand side are transferred or not to the silver halide grain depends largely on properties of the dye. With regard to the dye hole, a sensitization efficiency is considered to be better in the case where the dye hole is not transferred to the inside of the grain.

This subject is discussed in relation with an oxidation potential of the dye in Photographic Science and Engineering Vol. 24, page 138–143 (1980).

As described in Abstracts of International congress of Photographic Science, page 159–162 (1978) and Photographic Science and Engineering Vol. 17, page 235–244 (1973), it is suggested that a sensitizing dye of which hole remains on the surface of the silver halide grain bleaches a fog speck reduction sensitization speck located on the surface. Therefore, it is presumed that, in a most popular surface latent image forming type silver halide emulsion, the surface latent image is bleached, resulting in desensitization.

However, it is still uncertain that the reduction sensitization is to be applied to either of the surface or the inside of silver halide grains, or what kind of dye is to be effectively combined with the silver halide grains.

There have been known reduction sensitization methods, in which the reduction sensitization is applied to the surface of silver halide grains or during the course of forming the silver halide grains, or to seed crystal grains in advance in the case where the silver halide grains are grown up from the seed crystal grains.

In the case where the reduction sensitization is applied to the surface of the grains, a combination thereof with other sensitization such gold or sulfur sensitization results in an undesirable increase in fog so that it is not suitable for practical use. Contrary to that, in the case where the reduction sensitization is performed during the grain growth (in other words, the reduction sensitization is applied to the inside of the grain), there is no disadvatage as above-described.

Such a method is described in JP-A 48-87825 and 57-179835. There is reported, in these disclosures, an enhancement of inherent sensitivity of silver halide. However, they are silent with respect to spectral sensitivity thereof. This is presumed to be due to that surface latent-image is destructed by a dye hole which remains on the surface of silver halide crystal. It is also contemplated that a reduction sensitization speck localized inside the grain does not effectively trap the dye hole on the surface so that the reduction sensitization cannot be effectively achieved.

Accordingly, in order to accomplish an enhancement of sensitivity of surface latent image-forming type silver halide by a combined use of reduction sensitization and sulfur-gold sensitization, there have been known the following problems from viewpoint of an enhancement of spectral sensitivity.

1. In the case when being internally reduction-sensitized, there is no effect thereof on spectral sensitivity. In the case when being surface reduction-sensitized, any effect on the spectral sensitivity has not definitely proved as yet.

2. In the case when being surface reduction-sensitized, combined use thereof with sulfur-gold sensitization is difficult due to being highly fogged.

Relating to the above problems, there have been disclosed techniques for enhancement of sensitivity of a spectral-sensitized silver halide emulsion and improvements in storage stability and pressure resistance in JP-A 2-105139, 2-108038, 2-125247, 2-127636, 2-130545, 2-150837, 2-168247, 2-235047, 4-232945 and 4-32832.

However, it was found that these techniques led to deterioration in low-intensity reciprocity law failure and remarkable desensitization in cases when, after exposure, being allowed to stand over a long period of time under environment of a high temperature and high humidity.

SUMMARY OF THE INVENTION

In view of the foregoing problems, the present invention has been accomplished. Thus, an object of the present invention is to provide a silver halide emulsion improved in sensitivity and pressure desensitization and excellent in latent image stability and low-intensity reciprocity law failure.

The above object can be accomplished by a silver halide emulsion in which 30% or more by number of total silver halide grains contained therein are accounted for by tabular grains each comprising two or more silver halide phases different in silver iodide content from each other, in which a maximum (or highest) silver iodide-containing phase has a silver iodide content of not less than 5 mol % and less than 15 mol % and an outer phase adjacent thereto has a lower silver iodide content, said tabular grains each having 5 or more dislocation lines and a hole trap zone in an internal portion of the grain;

a silver halide emulsion in which 30% or more by number of total silver halide grains contained therein are accounted for by tabular grains each comprising two or more silver halide phases different in silver iodide content from each other, in which a maximum silver iodide-containing phase has a silver iodide content of not less than 5 mol % and less than 15 mol % and an outer phase adjacent thereto has a lower silver iodide content, said tabular grains each having 5 or more dislocation lines and having been internally reduction-sensitized;

said dislocation lines being located in an inner portion and fringe portion of the grain;

said silver halide emulsion being formed in the presence of an oxidizing agent, wherein said oxidizing agent is represented by the following formula (I), (II) or (III), $$R—SO_2S—M \quad (I)$$

$$R—SO_2S—R_1 \quad (II)$$

$$RSO_2S—Lm—SSO_2—R_2 \quad (III)$$

wherein R, $R_1$ and $R_2$, which may be the same with or different from each other, represent an aliphatic group, aromatic group or heterocyclic group, M and L represent a cation and a bivalaent linking group, respectively, and m is 0 or 1; and a silver halide photographic light sensitive material comprising a support having thereon a silver halide emulsion layer containing the silver halide emulsion as above-described.

DETAILED EXPLANATION OF THE INVENTION

The tabular grains of the present invention refer to grains having two parallel major faces and an aspect ratio of a circle equivalent diameter of the major face (i.e., a diameter of a circle having an area equivalent to the major face) to a grain thickness (i.e., a distance between the major faces) of 2 or more.

Not less than 50% of the projected area of total grains are accounted for by tabular grains having preferably an average aspect ratio of 3 or more, more preferably, 5 to 8. The average diameter of the tabular grains is within a range of 0.3 to 10 μm, preferably, 0.5 to 5.0 μm, more preferably, 0.5 to 2.0 μm. The average grain thickness is preferably 0.05 to 0.8 μm. The diameter and thickness of the grains can be determined according to a method described in U.S. Pat. No. 4,434,226.

With regard to the grain size disribution of the tabular grains, a coefficient of variation of the circle equivalent diameter of the major face, which is a standard deviation of the grain diameter divided by an average diameter, is preferably 30% or less, more preferably, 20% or less.

Photosensitive silver halide grains of the invention are preferably silver iodobromide or silver chloroiodobromide and more preferably, silver iodobromide. These grains have preferably a silver iodide content of 1 to 15 mol %, more preferably, 3 to 10 mol %. With regard to the fluctuation of the silver iodide content among grains, a variation coefficient of the silver iodide content (i.e., a standard deviation of the silver iodide content divided by an average silver iodide content) is preferably 30% or less, more preferably, 20% or less.

The tabular grains relating to the invention each comprise at least two silver halide phases which are different in the silver iodide content from each other. Among these phases, a phase having a maximum silver iodide content contains preferably silver iodide of not less than 5 mol % and less than 15 mol % of silver iodide and more preferably 5 to 8 mol %. The maximum silver iodide containing phase accounts for, preferably 30 to 90% (more preferably 30 to 60%) of the grain volume. An outer phase which is adjacent to the phase having the maximum silver iodide content contains preferably silver iodide of 0 to 8 mol % of silver iodide, more preferably, 2 to 5 mol %. This outer phase must not cover completely the maximum silver iodide-containing phase. The structure regarding the halide composition can be determined by X-ray diffraction method and EPMA method.

The surface of the tabular grains may have a silver iodide content higher than that of the maximum iodide containing phase. The surface silver iodide content is a value measured by a XPS method or ISS method. In the case when measured by a XPS method, the surface silver iodide content is preferably 0 to 12 mol %, more preferably, 5 to 10 mol %.

The suface silver iodide content can be determined by the XPS method in the following manner.

A sample is cooled down to −115° C. or lower under a super high vaccum of $1\times10^{-8}$ torr or less, exposed to X-ray of Mg-Kα line generated at a X-ray source voltage of 15 kV and X-ray source current of 40 mA and measured with respect to Ag3d5/2, Br3d and I3d3/2 electrons. From an integrated intensity of a peak measured which has been corrected with a sensitivity factor, the halide composition of the surface can be determined.

The maximum iodide containing phase within the tabular grain does not include a high iodide-localized region formed by a treatment which is carried out for the purpose of forming dislocation lines, as described later.

Tabular grains relating to the invention can be prepared by combining optimally methods known in the art. There can be referred, for example, known methods described in JP-A 61-6643 (1986), 61-146305 (1986), 62-157024 (1987), 62-18556 (1987), 63-92942 (1988), 63-151618 (1988), 63-163451 (1988), 63-220238 (1988) and 63-311244 (1988).

There may be optionally employed a silver halide solvent such as ammonia, thioethers and thioureas.

Silver halide grains can be grown using silver halide fine grains, as disclosed in JP-A 1-183417 (1989) and 1-183645 (1989). There may be employed two or more kinds of silver halide fine grains, at least one of which contains one kind of halide, as disclosed in JP-A 5-5966 (1993).

As disclosed in JP-A 2-167537 (1990), silver halide grains can be grown, at a time during the course of grain growth, in the presence of silver halide grains having a solubility product less than that of the growing grains. The silver halide grains having less solubility product are preferably silver iodide.

The dislocation lines in tabular grains can be directly observed by means of transmision electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high voltage type (over 200 KV for 0.25 μm thich grains). From the thus-obtained electron micrograph, the position and number of the dislocation lines in each grain can be determined in the case when being viewed from the direction perpendicular to the major face.

With respect to the position of the dislocation lines in the tabular grains relating to the present invention, it is preferable that the dislocation lines exist in a fringe portion of the major face. The term, "fringe portion" refers to a peripheral portion in the major face of the tabular grain. More specifically, when a straight line is drawn outwardly from the gravity center of the projection area projected from the major face-side, the dislocation lines exist in a region outer than 50% of the distance (L) between the intersection of the straight line with the outer periphery and the center, preferably, 70% or outer and more preferably 80% or outer. (In other words, the dislocation lines are located in the region between 0.5 L and L outwardly from the center of each grain, preferably between 0.7 L and L, more preferably between 0.8 L and L.) In the invention, accordingly, dislocation lines existing in portions other than the fringe portion is referred to as those of an inner portion.

With regard to the number of dislocation lines in the tabular grains relating to the present invention, tabular grains having dislocation lines of 5 or more per grain account for, preferably, not less than 30% (by number) of the total number of silver halide grains, more preferably not less than 50%, and furthermore preferably 80%. The number of the dislocation lines is preferably 10 or more per grain.

In the case when the dislocation lines exist both in the fringe portion and in the inner portion, it is preferable that 5 or more dislocations are present in the inner portion of the grain. More preferably, 5 or more dislocation lines are both in the fringe portion and in the inner portions.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution are added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add silver iodide fine grains or an iodide ion releasing compound, as an iodide sourse. It is more preferable to add silver iodide fine grains.

With regard to the position of the dislocation lines, it is preferable to introduce the dislocation lines after forming the maximum iodide containing silver halide phase. Specifically, the dislocation lines are introduced at a time after 50% (preferably 60%) of the total silver salt is added and before 95% (preferably 80%) of the total silver salt is added, during the course of forming silver halide grains used in the invention.

A silver halide emulsion of the present invention contains preferably a compound represented by the following formula (IV).

Formula (IV)

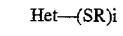

Het—(SR)i

In the formula, Het represents a heterocyclic ring; R represents a hydrogen atom, alkyl group, alkenyl group, aryl group or heterocyclic group; i is 0, 1 or 2, provided that Het or R has at least one of a group selected from —$SO_3$, —COOH and —OH, and a salt thereof.

Examples of the compound represented by formula (IV) are described in Japanese Patent Application 6-312075.

The word, "a hole trap zone" refers to a zone functionally capable of trapping a positive hole which has been produced in a couple with an electron produced upon photoexcitation. The hole trap zone can be detected by a microwave photoconductivity measurement or Dember effect measurement.

There are various methods for produce the hole trap zone within the grain. In the present invention, the hole trap zone can be produced by reduction sensitization or by doping metal ions within the grain.

The word, "internal portion of the grain" herein means an inner portion of 90% or less of the grain volume and preferably 70% or less. In the present invention, at least a part thereof may be the hole trap zone. It is preferable that the maximum iodide-containing silver halide phase is present in an inner portion of 90% or less of the grain volume, and the hole trap zone is formed within the maximum iodide-containing phase and/or the interface between the maximum iodide containing phase and the outer adjacent phase.

The reduction sensitization is conducted by adding a reducing agent to a silver halide emulsion or a reaction mixture for growing grains. Alternatively, the silver halide emulsion or mixture solution is subjected to ripening or grain growth at a pAg of 7 or less, or at a ph of 7 or more. These methods may be combined.

As a preferable reducing agent are cited thiourea dioxide, ascorbic acid or its derivative, and a stannous salt. Furthermore, a borane compound, hydrazine derivative, formamidine sulfinic acid, silane compound, amine or polyamine and sulfite are cited. The addition amount thereof is preferably $10^{-8}$ to $10^{-2}$ mol per mol of silver halide.

To conduct ripening at a low pAg, there may be added a silver salt, preferably aqueous soluble silver salt. As the aqueous silver salt is preferably silver nitrate. The pAg in the ripening is 7 or less, preferably 6 or less and more preferably 1 to 3 (herein, $pAg=-\log[Ag^+]$).

Ripening at a high pH is conducted by adding an alkaline compound to a silver halide emulsion or reaction mixture solution for growing grains. As the alkaline compound are usable sodium hydroxide, potassium hydroxide, sodium carbonate, potassium carbonate and ammonia. In a method in which ammoniacal silver nitrate is added for forming silver halide, an alkaline compound other than ammonia is preferably employed because of lowering an effect of ammonia.

The silver salt or alkaline compound may be added instantaneously or over a period of a given time. In this case, it may be added at a constant rate or accelerated rate. It may be added dividedly in a necessary amount. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

For preparing a silver halide emulsion of the invention, a process for growing grains from seed grains is preferably employed. To be more concretely, in the process, an aqueous solution containing protective colloid and seed crystal grains are made present in a reaction vessel in advance and silver ions, halide ions or silver halide fine grains are supplied thereto, so that the seed grains are grown up to final grains. The seed grains may be prepared by a single-jet process or a controlled double-jet process, which have been well known in the art. Any halide composition of the seed grains may be used, including any one of silver bromide, silver iodide, silver chloride, silver iodobromide, silver chloroiodide, silver chlorobromide and silver chloroiodobromide. Among them, silver bromide and silver iodobromide are preferable. In the case of silver iodobromide, the average silver iodide content thereof is preferably 1 to 20 mol %.

In the process of growing grains from seed grains, it is preferable that the ripening at a low pAg is carried out by adding silver nitrate after the formation of the seed grains, that is to say, ripening is preferably carried out by adding silver nitrate during the course from a time immediately before desalting a seed grain emulsion to a time after completing the desalting. It is particularly preferable to add silver nitrate after desalting to ripen the seed grains. The ripening temperature is to be 40° C. or higher, preferably 50° to 80° C. The ripening time is to be 30 min. or more, preferably 50 to 150 min.

In the case when the ripening at a high pH is carried out in the process of the grain growth from the seed grains, it is necessary to the grains by subjecting them to an environment having a pH of 7 or more before 70% of the ultimate grain volume of the grown-up grains is reached. It is preferable to grow up the grains by subjecting them to an environment having a pH of 8 or more at least once before 50% of the ultimate grain volume of the grow-up grains is reached, it is more preferable to grow up the grains by subjecting them to an enviroment having a pH of 8 or more before 40% of the ultimate grain volume of the grown-up grains is reached.

The oxidizing agent used in the invention refers to a compound capable of acting metallic silver to convert to silver ions. There is effectively used a compound capable of makin conversion of a fine silver cluster produced during the course of the formation of silver halide grains to silver ions. The silver ions formed may form a sparingly water-soluble salt such as silver halide, silver sulfide or silver, or may form an aqueous-soluble silver sAly such as silver nitrate.

The oxidizing agent may be an organic or inorganic compound. As examples of inorganic oxidizing agents are cited ozone, hydrogen peroxide and its adduct (e.g., $NaBO_2—H_2O_2—3H_2O$, $2NaCO_3—3H_2O_2$, $Na_4P_2O_7—2H_2O_2$, $2Na_2SO_4—H_2O_2—H_2O$), peroxy acid salt (e.g., $K_2S_2o_8$, $k_2C_2O_6$, $K_4P_2O_8$), peroxy complex compound (e.g., $K_2[Ti(O_2)C_2O_4]3H_2O$, $4K_2SO_4Ti(O_2)OHSO_42H_2O$, $Na_3[VO(O_2)(C_2O_4)_2]6H_2O$), oxy acid salt such as permanganate salt (e.g., $KMnO_4$) or chromate salt ($K_2Cr_2O_7$), halogen elements such as iodine and bromine, perhalogenate silt (e.g., potassium periodate), polyvalent metal salt (e.g., potassium ferric hexacyanate) and thiosulfonate. As examples of organic oxidizing agent are cited a quinone such as p-quinone, organic peroxide such as peracetic acid or perbenzoic acid and a compound capable of releasing an active halogen (e.g., N-bromsucciimide, chloramine T, chloramine B).

Among these compounds, preferable oxidizing agents are ozone, hydrogen peroxide and its adduct, halogen elements, thiosulfonate, and quinones, more preferably a thiosulfonate represented by formula (III) afore-described, furthermore preferably a compound represented by formula (I).

It was reported in S. Gahler, Veroff wiss.Photolab Wolfen X, 63 (1965) that thiosulfonic acid oxidizes silver to form silver sulfide according to the following reaction.

$$RSO_2SM+2Ag \rightarrow RSO_2M+Ag_2S$$

A compound represented by formulas (I) to (III) may be a polymer containing a bivalent repeating unit derived from these structures; and R, $R_1$, $R_2$ an L may be combined with each other to form a ring.

A thiosulfonate compound represented by formulas (I) to (III) will be explained more in detail. In case of R, $R_1$ and $R_2$ being an aliphatic group, they are a saturated or unsaturated, straight or branched, or cyclic aliphatic hydrocarbon group; preferably, an alkyl group having 1 to 22 carbon atoms (e.g., methyl, ethyl, propyl, butyl, pentyl, hexyl, octyl, 2-ethylhexyl, decyl, dodecyl, hexadecyl, octadecyl, cyclohexyl, isopropyl, t0butyl, etc.); an alkenyl group having 2 to 22 carbon atoms (allyl, butenyl, etc.) and an alkynyl group (propargyl, butynyl etc.). These group may be substituted.

In case of R, $R_1$ and $R_2$ being an aromatic group, they include a monocyclic and condensed ring, aromatic hydrocarbon groups, preferably those having 6 to 20 carbon atoms such as phenyl. These may be substituted.

In case of R, $R_1$ and $R_2$ being a heterocyclic group, they contain at least one selected from nitrogen, oxygen, sulfur, selenium and tellurium atoms, being each 3 to 15-membered ring (preferably, 3 to 6-membered ring) having at least one carbon atom, such as pyrroridine, piperidine, pyridine, tetrahydrofuran, thiophene, oxazole, thiazole, imidazole, benzothiazole, benzooxazole, benzimidazole, selenazole, benzoselenazole, tetrazole, triazole, benzotriazole, oxadiazole and thiadiazole.

As a substituent for R, $R_1$ and $R_2$, are cited an alkyl group (e.g., methyl, ethyl, hexyl etc.), alkoxy group (e.g., methoxy, ethoxy, octyloxy, etc.), aryl group (e.g., phenyl, naphthyl, tolyl etc.), hydroxy group, halogen atom (e.g., fuorine, chlorine, bromine, iodine), aryloxy group (e.g., pheoxy), alkylthio (e.g., methythio, butylthio), arylthio group (e.g., phenylthio), acyl group (e.g., acetyl, propinyl, butylyl, valeryl etc.), sulfonyl group (e.g., methysulfonyl, phenylsulfonyl), acylamino group (e.g., acetylamino, benzoylamino), sulfonylamino group (e.g., methanesulfonylamino, benzenesulfonylamino, etc.), acyoxy group (e.g., acetoxy, benzoxy, etc.), carboxy group, cyano group, sulfo group, amino group, —$SO_2SM$ group (M is a monovalent cation) and —$SO_2R_1$.

A bivalent linking group represented by L is an atom selected from C, N, S and O or an atomic group containing at least one of them. Examples thereof are an alkylene group, alkenylene group, alkynylene group, arylene group, —O—, —S—, —NH—, —CO— or —$SO_2$—, or a combination thereof.

L is preferably a bivalent aliphatic or aromtic group. Examples of the aliphatic group include $$\text{-}(CH_2)_n\text{-} \quad (n = 1 \text{ to } 12)$$

$$-CH_2-CH=CH-CH_2-$$

$$-CH_2C\equiv CCH_2-$$

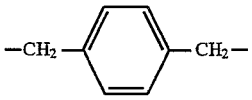

and xylylene group. As the aromatic group, are cited phenylene group and naphthylene group.

These groups may have a substituent as afore-described.

M is preferably a metallic ion or organic cation. As the metallic ion are cited lithium ion, sodium ion and potassium ion. As the organic cation are cited an ammonium ion ( e.g., ammonium, tetramethyammonium, tetrabutylammonium, etc.), phosphonium ion (e.g., tetraphenylphosphonium) and guanidyl group.

In the case where a compound represented by formulas (I) to (III) is a polymer, a repeating unit thereof is as follows. These polymer may be a homopolymer or copolymer with other copolymerizing monomers.

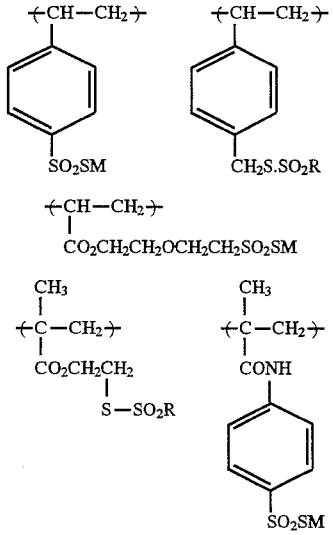

Examples of the compounds represented by formulas (I) to (III) are described in JP-A 54-1019, British Patent No. 972,211 and Journal of Organic Chemistry vol. 53, page 396 (1988).

$CH_3SO_2SNa$ (1-1)

$C_2H_5SO_2SNa$ (1-2)

$C_3H_7SO_2SK$ (1-3)

$C_4H_9SO_2SLi$ (1-4)

$C_6H_{13}SO_2SNa$ (1-5)

$C_8H_{17}SO_2SNa$ (1-6)

$CH_3(CH_2)_3CH(C_2H_5)CH_2SO_2S.NH_4$ (1-7)

$C_{10}H_{21}SO_2SNa$ (1-8)

$C_{12}H_{25}SO_2SNa$ (1-9)

$C_{16}H_{33}SO_2SNa$ (1-10)

$(CH_3)_2CH-SO_2SK$ (1-11)

t-$C_4H_9SO_2SNa$ (1-12)

$CH_3OCH_2CH_2SO_2S.Na$ (1-13)

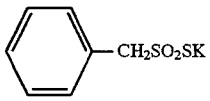
(1-14)

$CH_2=CHCH_2SO_2SNa$ (1-15)

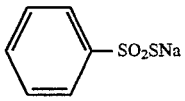
(1-16)

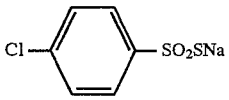
(1-17)

-continued
(1-18)
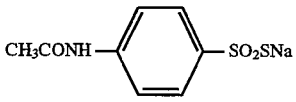
(1-19)
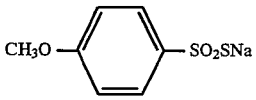
(1-20)
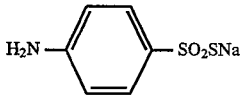
(1-21)
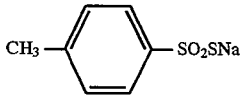
(1-22)
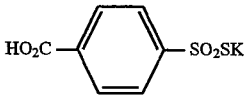
(1-23)
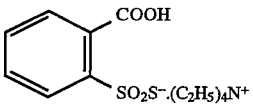
(1-24)
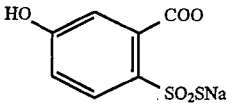
(1-25)
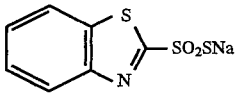
(1-26)
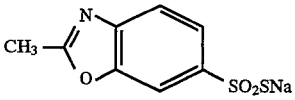
(1-27)
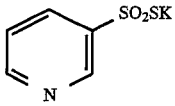
(1-28)
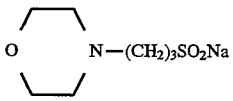
$NaSO_2(CH_2)_2SO_2SK$ (1-29)
$NaSO_2(CH_2)_4SO_2SNa$ (1-30)
$NaSSO_2(CH_2)_4S(CH_2)_4SO_2SNa$ (1-31)
(1-32)
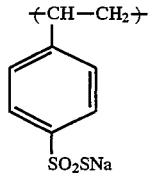
-continued
(1-33)
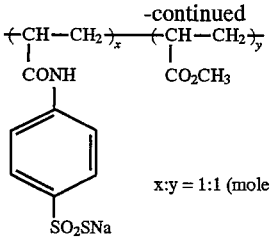
x:y = 1:1 (mole ratio)
$C_2H_5SO_2S-CH_3$ (2-1)
$C_8H_{17}SO_2SCH_2CH_3$ (2-2)
(2-3)
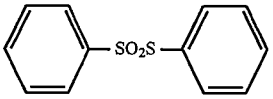
(2-4)
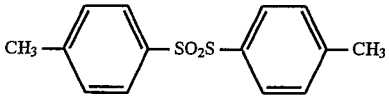
$C_2H_5SO_2SCH_2CH_2CN$ (2-5)
(2-6)
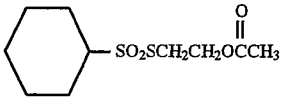
(2-7)
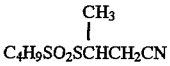
(2-8)
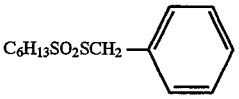
(2-9)
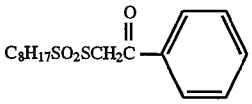
(2-10)
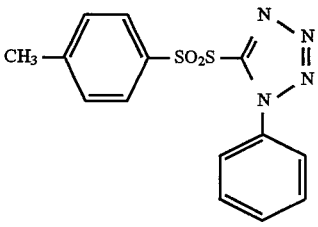
(2-11)
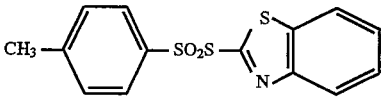
(2-12)
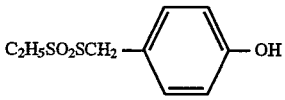
(2-13)
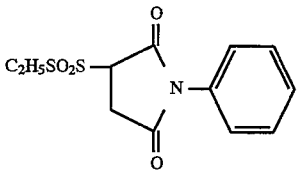

-continued (2-14)

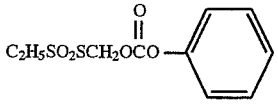

(2-15)

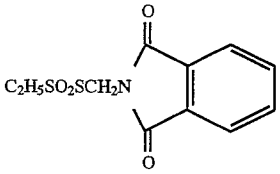

(2-16)

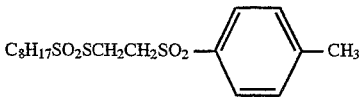

(2-17)

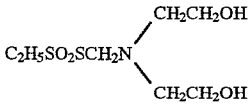

(2-18)

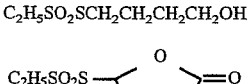

(2-19)

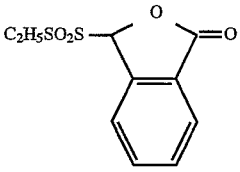

(2-20)

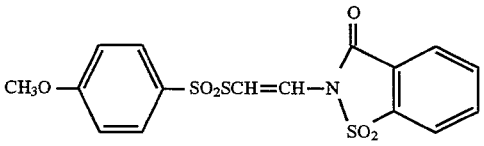

(2-21)

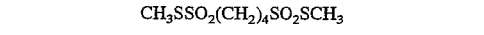

(2-22)

(2-23)

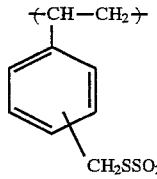

(2-24)

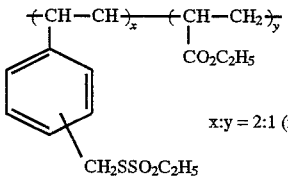

x:y = 2:1 (mole ratio)

(2-25)

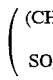

(3-1)

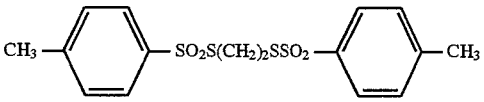

(3-2)

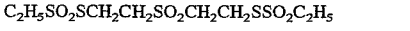

(3-3)

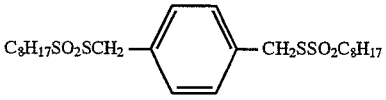

-continued (3-4)

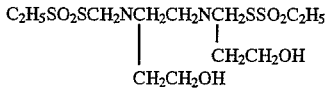

(3-5)

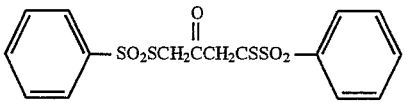

(3-6)

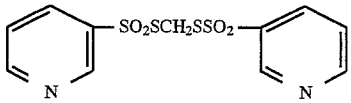

(3-7)

(3-8)

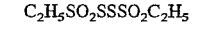

(3-9)

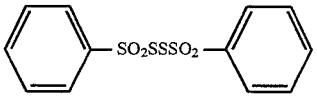

The addition amount of the oxidizing agent is $10^{-7}$ to $10^{-1}$, preferably $10^{-6}$ to $10^{-2}$, more preferably $10^{-5}$ to $10^{-3}$ mol per mol of silver. The oxidizing agent is added at a time during the course of forming silver halide grains, preferably before or during the formation of different halide compositions of the grain. Additives may be added into an emulsion in such a conventional manner that an aqueous-soluble compound is dissolved in water to form a solution with an appropriate concentration, water-insoluble or sparingly soluble compound is dissolved in an aqueous-miscible organic solvent (e.g., alcohols, glycols, ketones, esters and amides); and the resulting solution is added to the emulsion.

In the present invention, a polyvalent metal ion occluded in silver halide grains can be optimally selected for the purpose of forming the hole trap zone within the grain. Examples thereof include ions of metals such as Mg, Al, Ca, Sc, Ti, V, Cr, Mn, Fe, Co, Ni, Cu, Zn, Ga, Ge, Sr, Y, Zr, Nb, Mo, To, Ru, Pd, Cd, Sn, Sb, Ba, La, Hf, Ta, Ce, Eu, W, Re, Os, Ir, Pt, Au, Tl, Pb, Bi and In. These ions may be used singly or in combination thereof. A metal salt compound can be selected from simple salt, it may be a monocyclic complex or polycyclic complex; it is preferably selected from six-coordinated, five-coordinated, four-coordinated and two-coordinated complexes. Among them are more preferable octahedral six-coordinated complex and tabular four-coordinated complex. As a ligand constituting the complex is cited $CN^-$, CO, $NO_2^-$, 1,10-phenanthrolin, 2,2-bipyridine, $SO_3^{2-}$, ethylenediamine, $NH_3$, pyridine, $H_2O$, $NCS^-$, $NCO^-$, $NO_3^-$, $SO_4^{2-}$, $OH^-$, $CO_3^{2-}$, $SSO_3^{2-}$, $N_3^-$, $S^{2-}$, $F^-$, $Cl^-$, $Br^-$, and $I^-$.

In the invention, $Pb^{2=}$, $In^{=}$, $In^{3=}$, $Ir^{3=}$, $Ir^{4=}$, or $Fe^{2=}$ is occluded within the grain.

The metal compound may be added in the form of a solution or solid. It may be added to reaction mother liquor prior to or during the growth of silver halide grains. To control the metal ion distribution within the grain, there can be employed a method as disclosed inn Japanese Patent Application No. 5-122806 (1993). An addition amount thereof is $1\times10^{-10}$ to $1\times10^{-2}$, preferably $1\times101\times10^{-9}$ to $5\times10^{-4}$ mol per mol of silver.

Other emulsion techniques as described in Research Disclosure (herein after, denoted as RD) No. 308119 may be applied to the silver halide emulsion of the invention. There may be acceptable additives used in physical ripening, chemical ripening and spectral sensitizing processes as described in RD 17643, 18716 and 308119, other photographic additives, couplers, supports and processing methods. Methods for dispersing additives and layer arrangements are also described in RD 308119.

The silver halide emulsion of the invention can be applicable to color photographic materials such as a color negative film, color reversal film, color print paper, color positive film and color positive paper and black-and-white photographic materials such as X-ray photographic films, film for use in printing and black-and-white camera films.

EXAMPLES

Embodiments of the present invention will be explained in detail, however, the invention is not limited thereto.

Example 1

Preparation of seed grain emulsion, T-1;

A seed emulsion was prepared in the following maner.

Using a mixing stirrer described in Japanese Patent examined No. 58-58288, an aqueous silver nitrate solution (1.161 mol) and aqueous mixture solution of potassium bromide and potassium iodide (potassium iodide, 2 mol %) were simultaneously added to the following solution, A1 by a double jet method over a period of 2 min., while being kept at a temperature of 35° C. and a silver potential of 0 mV, which was measured by a silver ion selection electrode using a saturated silver-silver chloride electrode as a reference electrode.

Subsequently, the temperature of the reaction mixture was raised to 60° C. by taking 60 min. and, after being adjusted to a pH of 5.0, an aqueous silver nitrate solution (5.902 mol) and an aqueous solution of potassium bromide and potassium iodide (potassium iodide, 2 mol %) were added by a double jet method over a period of 42 min., while being maintained at a silver potential of 9 mV. After completing the addition, the temperature was lowered to 40° C. and the emulsion was desalted by conventional flocculation method.

The resulting seed emulsion was proved to be comprised of hexagonal tabular grains having an average sphere equivalent diameter of 0.24 μm, an average aspect ratio of 4.8 and a maximum adjacent edge ratio of 1.0 to 2.0, accounting for 90% of the projected area of total grains. The emulsion was referred to as Seed emulsion T-1.

| Solution A1 | |
|---|---|
| Ossein gelatin | 24.2 g |
| Potassium bromide | 10.8 g |
| Sodium polypropyleneoxy-polyethyleneoxy-disuccinate (10% ethanol solution) | 6.78 ml |
| 10% Nitric acid | 114 ml |
| Water | 9657 ml |

Preparation of Seed Grain Emulsion, T-2:

The seed emulsion T-1 desalted was dispersed with stirring at 60° C. for 15 min. and the pAg of the emulsion was adjusted to 1.88 by adding a aqueous silver nitrate solution, then, the emulsion was further ripened at 60° C. for 80 min., with stirring. Thereafter, an aqueous potassium bromide solution was added to the emulsion to vary the pAg again to the same value as one before the addition of the silver nitrate solution and the temperature was lowered to 40° C.

The thus-obtained seed grain emulsion was proved to be comprised of hexagonal tabular grains having an average sphere equivalent diameter of 0.24 μm, an average aspect ratio of 4.8 and a maximum edge ration of 1.0 to 2.0, accounting for 90% of the projected area of total grains. The emulsion was referred to as Seed emulsion T-2.

Preparation of Seed Grain Emulsion, T-3:

A seed emulsion T-3 was prepared in the same manner as the seed emulsion T-1, except that the pAg was adjusted to 2.70.

The resulting emulsion was proved to be comprised of hexagonal tabular grains having an average sphere equivalent diameter of 0.24 μm, an average aspect ratio of 4.8 and a maximum edge ratio of 1.0 to 2.0, accounting for 90% of the projected area of total grains.

Preparation of Silver Iodide Fine Grain Emulsion, SMC-1:

To 5 liters of a 6.0 wt. % gelatin aqueous solution containing potassium iodide of 0.06 mol, an aqueous solution containing 7.06 mol of silver nitrate and an aqueous solution containing 7.06 mol of potassium iodide, each 2 liters were added with vigorously-stirring over a period of 10 min., while the pH was maintained at 2.0 with addition of nitric acid and the temperature was controlled at 40° C. After completing the grain formation, the pH was adjusted to 5.0 with an aqueous solution of sodium carbonate. The resulting silver iodide fine grain emulsion was proved to have an average grain size of 0.05 μm. The emulsion was referred to as SMC-1.

Preparation of Comparative Emulsion. Em-1:

700 ml of a 4.5 wt. % inert gelatin aqueous solution containing a seed emulsion T-1 (0.178 mol equivalent) and 0.5 ml of 10% polyisoprene-polyethylene-disuccinic acid ester sodium salt ethanol solution was maintained at 75° C. and the pAg and pH were adjusted to 9.0 and 5.0, respectively. Thereafter, grain formation was carried out by a double jet method with vigorous stirring according to the following sequence.

1) An aqueous silver nitrate solution (0.692 mol), 0.297 mol of SMC-1 and an aqueous potassium bromide solution were added, while being kept at a pAg of 9.0 and pH of 5.0.
2) Subsequently, an aqueous silver nitrate solution (2.295 mol), 0.071 mol of SMC-1 and an aqueous potassium bromide solution were added, while being kept at a pAg of 9.0 and pH of 5.0.

During the course of grain formation, each solution was added at an optimal flowing rate not so as to form new nuclear grains and cause Ostwald ripening. After completing the addition, desalting was carried out by a conventional flocculation method and after adding gelatin thereto, the pAg and pH each were adjusted to 8.1 and 5.8.

The resulting emulsion was proved to be comprised of tabular grains having an average cube-equivalent edge length of 0.65 μm and an average aspect ratio of 4.3. According to the electron micrograph, there was observed no grain having a dislocation line. It was further proved that the tabular grains each comprised plural silver halide phases different in the silver iodide content, as shown in Table 1.

Preparation of Comparative Emulsion. Em-2:

700 ml of a 4.5 wt. % inert gelatin aqueous solution containing a seed emulsion T-1 (0.178 mol equivalent) and 0.5 ml of 10% polyisoprene-polyethylene-disuccinic acid ester sodium salt ethanol solution was maintained at 75° C. and the pAg and pH were adjusted to 9.0 and 5.0, respectively. Thereafter, grain formation was carried out by a double jet method with vigorous stirring according to the following sequence.

1) Art aqueous silver nitrate solution (0.2.121 mol), 0.297 mol of SMC-1 and an aqueous potassium bromide solution were added, while being kept at a pAg of 9.0 and pH of 5.0.
2) Subsequently, the temperature of the mixture was lowered to 60° C. Then, an aqueous silver nitrate solution (1.028 mol), 0.032 mol of SMC-1 and an aqueous potassium bromide solution were added, while being kept at a pAg of 9.6 and pH of 5.0.

During the course of grain formation, each solution was added at a optimal flowing rate so as not to produce new nuclear grains and cause Ostwald ripening. After completing the addition, desalting was carried out by a conventional flocculation method and after adding gelatin thereto, the pAg and pH were each adjusted to 8.1 and 5.8.

The resulting emulsion was proved to be comprised of tabular grains having an average cube-equivalent edge length of 0.65 μm and an average aspect ratio of 4.1. According to the electron micrograph, there was observed no grain having a dislocation line.

Preparation of Comparative Emulsion, Em-3;

An emulsion, Em-3 was prepared in the same manner as Em-2, except that the seed emulsion was replaced by T-2.

The resulting emulsion was proved to be comprised of tabular grains having an average cube-equivalent edge length of 0.65 μm and an average aspect ratio of 4.5. According to the electron micrograph, there was observed no grain having a dislocation line.

Preparation of Comparative Emulsion, Em-4:

700 ml of a 4.5 wt. % inert gelatin aqueous solution containing a seed emulsion T-1 (0.178 mol equivalent) and 0.5 ml of 10% polyisoprene-polyethylene-disuccinic acid ester sodium salt ethanol solution was maintained at 75° C. and the pAg and pH were adjusted to 9.0 and 5.0, respectively. Thereafter, grain formation was carried out by a double jet method with vigorous stirring according to the following sequence.

1) An aqueous silver nitrate solution (2.121 mol), 0.174 mol of SMC-1 and an aqueous potassium bromide solution were added, while being kept at a pAg of 8.6 and pH of 5.0 (formation of host grains).

2) Subsequently, the temperature of the mixture was lowered to 60° C. and the pAg was adjusted to 9.4. Then, SMC-1 of 0.071 mol was added thereto and ripening was carried out for 2 min. (introduction of dislocation lines).

3) An aqueous silver nitrate solution (0.959 mol), 0.030 mol of SMC-1 and an aqueous potassium bromide solution were added, while being kept at a pAg of 9.4 and pH of 5.0 (shell formation).

During the course of grain formation, each solution was added at an optimal flowing rate not so as to form new nuclear grains and cause Ostwald ripening. After completing the addition, desalting was carried out by a conventional flocculation method and after adding gelatin thereto, the pAg and pH were each adjusted to 8.1 and 5.8.

The resulting emulsion was proved to be comprised of tabular grains having an average cube-equivalent edge length of 0.65 μm and an average aspect ratio of 6.6. According to the electron micrograph, there was observed not less than 80% (by number) of the grains, each having 5 or more dislocation lines in each of the fringe portion and the inner portion thereof.

Preparation of Inventive Emulsion, Em-5:

An emulsion, Em-5 was prepared in the same manner as Em-4, except that the seed emulsion was replaced by T-2.

The resulting emulsion was proved to be comprised of tabular grains having an average cube-equivalent edge length of 0.65 μm and an average aspect ratio of 6.6. According to the electron micrograph, there was observed not less than 80% (by number) of the grains, each having 5 or more dislocation lines in each of the fringe portion and the inner portion thereof.

Preparation of Inventive Emulsion, Em-6:

An emulsion Em-6 was prepared in the same manner as Em-5, except that a thiosufonic acid compound (1-2), as an oxidizing agent was added in an amount of $6.0\times10^{-5}$ mol/mol Ag.

The resulting emulsion was proved to be comprised of tabular grains having an average cube-equivalent edge length of 0.65 μm and an average aspect ratio of 6.6. According to the electron micrograph, there was observed not less than 80% (by number) of the grains, each having 5 or more dislocation lines in each of the fringe portion and the inner portion thereof.

Preparation of Inventive Emulsion, Em-7:

An emulsion, Em-7 was prepared in the same manner as Em-5, except that adding amounts of an aqueous silver nitrate solution and SMC-1 were varied for the host grains so as to have a silver iodide content as shown in table 1, and the pAg in the step of forming host grains and that in the steps of introducing dislocation lines and shelling the host grains were varied to 8.4 and 9.8, respectively.

The resulting emulsion was proved to be comprised of tabular grains having an average cube-equivalent edge length of 0.65 μm and an average aspect ratio of 7.1. According to the electron micrograph, there was observed not less than 80% (by number) of the grains, each having 5 or more dislocation lines in the fringe portion.

Preparation of Inventive Emulsion, Em-8:

An emulsion, Em-8 was prepared in the same manner as Em-5, except that adding amounts of an aqueous silver nitrate solution and SMC-1 were varied for the host grains so as to have a silver iodide content as shown in Table 1, the pAg in the step of forming host grains and that in the steps of introducing dislocation lines and shelling the host grains were varied to 8.4 and 9.8, respectively, and a thiosufonic acid compound (1-6), as an oxidizing agent was added in an amount of $6.0\times10^{-5}$ mol/mol Ag.

The resulting emulsion was proved to be comprised of tabular grains having an average cube-equivalent edge length of 0.65 μm and an average aspect ratio of 7.1. According to the electron micrograph, there was observed not less than 80% (by number) of the grains, each having 5 or more dislocation lines in the fringe portion.

Preparation of Inventive Emulsion Em-9:

An emulsion, Em-9 was prepared in the same manner as Em-5, except that the pAg in the step of forming host grains and that in the steps of introducing dislocation lines and shelling the host grains were varied to 8.3 and 9.6; host grain formation was followed by shell formation, in which additions of an aqueous silver nitrate solution, SMC-1 and an aqueous potassium bromide solution were interrupted, the dislocation lines were introduced in the same manner as in Em-5 and then the shell formation was further conducted; and a thiosufonic acid compound (1-16), as an oxidizing agent was added in an amount of $6.0\times10^{-5}$ mol/mol Ag.

The resulting emulsion was proved to be comprised of tabular grains having an average cube-equivalent edge length of 0.65 μm and an average aspect ratio of 4.4. According to the electron micrograph, there was observed not less than 80% (by number) of the grains, each having 5 or more dislocation lines in each of the fringe portion and the inner portion thereof.

Preparation of Invent Emulsion Em-10:

An emulsion, Em-10 was prepared in the same manner as Em-8, except that the seed emulsion was varied to T-3; an aqueous silver nitrate solution and SMC-1 in the step of forming the host grains were respectively varied to 2.066 mol equivalence and 0.230 mol; and the oxidizing agent was changed to $H_2O_2$.

The resulting emulsion was proved to be comprised of tabular grains having an average cube-equivalent edge length of 0.65 μm and an average aspect ratio of 4.0. According to the electron micrograph, there was observed not less than 80% (by number) of the grains, each having 5 or more dislocation lines in each of the fringe portion and the inner portion thereof.

Preparation of Comparative Emulsion, Em-11:

An emulsion, Em-11 was prepared in the same manner as Em-5, except that adding amounts of an aqueous silver nitrate solution and SMC-1 were varied for the host grains so as to contain iodide as shown in Table 1, the pAg in the step of forming host grains and that in the steps of introducing dislocation lines and shelling the host grains were varied to 8.3 and 9.6, respectively.

The resulting emulsion was proved to be comprised of tabular grains having an average cube-equivalent edge length of 0.65 μm and an average aspect ratio of 3.8. According to the electron micrograph, there was observed not less than 80% (by number) of the grains, each having 5 or more dislocation lines both in the fringe portion and inner portion thereof.

Preparation of Inventive Emulsion Em-12:

An emulsion, Em-12 was prepared in the same manner as Em-5, except that an aqueous silver nitrate solution and SMC-1 in the step of forming the host grains were respectively varied to 2.188 mol equivalence and 0.108 mol; and a thiosulfonic acid compound (1-2), as an oxidizing agent, was added in an amount of $6.0\times10^{-5}$ mol Ag The resulting emulsion was proved to be comprised of tabular grains having an average cube-equivalent edge length of 0.65 μm and an average aspect ratio of 7.0. According to the electron micrograph, there was observed not less than 80% (by number) of the grains, each having 5 or more dislocation lines in the fringe portion thereof.

Emulsions Em-1 to Em-12 were subjected to the Dember effect measurement. As a result, each of emulsions Em-5 through Em-10 was proved to have the hole trap zone within the grain. Characteristics of the emulsions are summarized as shown in Table 1.

TABLE 1

| Emulsion No. | Seed emulsion | Grain structure[1)] (volume ratio) | Aspect ratio[2)] | Dislocation lines Fringe | Dislocation lines Inner | Oxidizing agent | Reduction sens[3)] | Remark |
|---|---|---|---|---|---|---|---|---|
| Em-1 | T-1 | 2/30/3 (5/28/67) | 4.3 | No | No | No | No | Comp. |
| Em-2 | T-1 | 2/7.6/3 (5/65/30) | 4.5 | No | No | No | No | Comp. |
| Em-3 | T-2 | 2/7.6/3 (5/65/30) | 4.5 | No | No | No | Yes | Comp. |
| Em-4 | T-1 | 2/7.6/X/3 (5/65/2/28) | 6.6 | Yes | Yes | No | No | Comp. |
| Em-5 | T-2 | 2/7.6/X/3 (5/65/2/28) | 6.6 | Yes | Yes | No | Yes | Inv. |
| Em-6 | T-2 | 2/7.6/X/3 (5/65/2/28) | 6.6 | Yes | Yes | 1–2 | Yes | Inv. |
| Em-7 | T-2 | 2/5.4/X/3 (5/65/2/28) | 7.1 | Yes | No | No | Yes | Inv. |
| Em-8 | T-2 | 2/5.4/X/3 (5/65/2/28) | 5.3 | Yes | Yes | 1–6 | Yes | Inv. |
| Em-9 | T-2 | 2/7.6/3/X/3 (5/65/10/2/18) | 4.4 | Yes | Yes | 1–16 | Yes | Inv. |
| Em-10 | T-3 | 2/10/X/3 (5/65/2/28) | 4.0 | Yes | Yes | $H_2O_2$ | Yes | Inv. |
| Em-11 | T-2 | 2/16/X/3 (5/65/2/28) | 3.8 | Yes | Yes | No | Yes | Comp. |
| Em-12 | T-2 | 2/4.7/X/3 (5/65/2/28) | 7.0 | Yes | No | 1–2 | Yes | Comp. |

[1)]: Iodide content of each phase (mol %); volume ratio (%) of each phase in parentheses; dislocation-introduced position designated as X
[2)]: Aspect ratio of 50% of the projected area of total grains
[3)]: Reduction sensitization Adding the folowing sensitizing dyes S-1 to 3, sodium thiosulfate, chloroauric acid and potassium thiocyanate to each of the emulsions, Em-1 to 12, chemical sensitization was optimally conducted according to the conventional manner. After completing the chemical sensitization, a stabilizer ST-1 and antifoggant AF-1 were added to the emulsion in an amount of 500 mg and 10 mg per mol of silver halide.

To each of the resulting emulsions, there were added the following cyan coupler C-1, emulsified dispersion, surfactant and hardener to prepare a coating solution. The coating solution was coated on a support of subbed cellulose triacetate according to the conventional manner and dried to prepare each of samples 101 to 112.

S-1

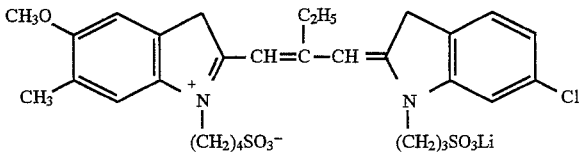

S-2

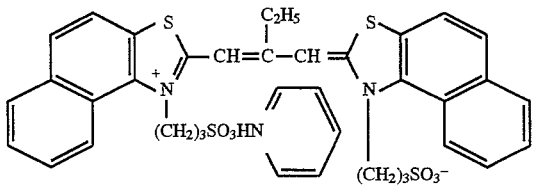

S-3

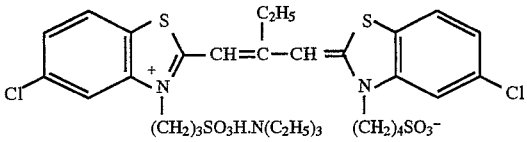

C-1

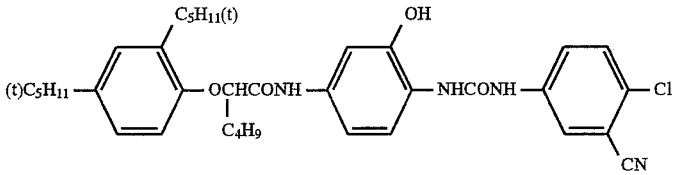

ST-1

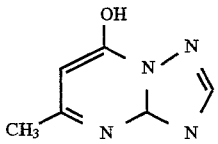

AF-1

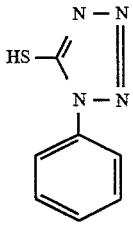

These samples were exposed (1/200 sec.) through an optical wedge in a conventional manner, using a light source having a color temperature of 5400° K. and filtered with a glass filter Y-48 produced by Toshiba to evaluate with respect to relative sensitivity, latent image stability and pressure desensitization.

Relative Sensitivity:

Samples were processed within 1 min. after exposure according to the following steps. Relative sensitivity was expressed as reciprocal of exposure necessary for giving a red density (optical density) of fog plus 0.15, based on that of sample 101 being 100.

Latent Image Stability:

After exposure, the samples were allowed to stand over a period of 7 days under an atmosphere at a temperature of 23° C. and a relative humidity (RH) of 80% and thereafter processed. The stability was evaluated with respect to the relative sensitivity, which was shown as a relative value, based on the sensitivity obtained immediately after exposure being 100.

Pressure Desensitization:

Exposed samples were allowed to stand over a period of 24 hrs. under an atmosphere at 23° C. and 80% RH so as to adjust a moisture content of each sample. Samples each were scratched at a speed of 1 cm/sec. with a needle, applying a load of 5 g to the needle having, on its top, a sapphire with a radius of curvature of 0.025 mm, thereafter the samples were subjected to processing.

The pressure desensitization was represented in terms of a density loss at a density of fog plus 0.4 on scratching with the needle, that is to say, a density loss, ΔD normalized by a maximum density, Dmax (i.e., ΔD/Dmax).

Low Intensity Reciprocity Law Failure (LIRF):

The reciprocity response was evaluated in the same manner as in the sensitivity evaluation above-described, except that exposure time was changed to 8 sec. Thus obtained sensitivity divided by the sensitivity at 1/200 sec. exposure was referred to as a characteristic value of low intensity reciprocity law failure. The characteristic value divided by that of Sample 101 was shown as a relative characteristic value of low intensity reciprocity law failure.

Processing Procedure:

| Processing step | Time | | Temperature | Replenishing rate |
|---|---|---|---|---|
| Color developing | 3 min. | 15 sec. | 38 ± 0.3° C. | 780 ml/m$^2$ |
| Bleaching | | 45 sec. | 38 ± 2.0° C. | 150 ml/m$^2$ |
| Fixing | 1 min. | 30 sec. | 38 ± 2.0° C. | 830 ml/m$^2$ |
| Stabilizing | | 60 sec. | 38 ± 5.0° C. | 830 ml/m$^2$ |
| drying | 1 min. | | 55 ± 5.0° C. | |

Results obtained are shown in Table 2.

TABLE 2

| Sample No. | Emulsion | Sensitivity Fresh | Sensitivity Aged | LIRF (relative) | ΔD/Dmax | Remarks |
|---|---|---|---|---|---|---|
| 101 | Em-1 | 100 | 90 | 1.00 | −45% | Comp. |
| 102 | Em-2 | 70 | 42 | 0.78 | 0% | Comp. |
| 103 | Em-3 | 73 | 43 | 0.85 | 0% | Comp. |
| 104 | Em-4 | 135 | 100 | 0.81 | −5% | Comp. |
| 105 | Em-5 | 140 | 130 | 1.16 | −5% | Inv. |
| 106 | Em-6 | 136 | 133 | 1.28 | −4% | Inv. |
| 107 | Em-7 | 115 | 104 | 1.15 | −3% | Inv. |
| 108 | Em-8 | 100 | 97 | 1.32 | −3% | Inv. |
| 109 | Em-9 | 105 | 102 | 1.29 | −11% | Inv. |
| 110 | Em-10 | 110 | 105 | 1.21 | −18% | Inv. |
| 111 | Em-11 | 103 | 59 | 0.92 | −32% | Comp. |
| 112 | Em-12 | 85 | 65 | 0.97 | −3% | Comp. |

As shown in the Table, according to the inventive emulsions, there has been achieved a silver halide photographic light sensitive material improved in sensitivity, latent image stability, low intensity reciprocity law failure and pressure desensitization.

What is claimed is:

1. A silver halide photographic emulsion containing tabular silver halide grains each comprising plural silver halide phases different in a silver iodide content from each other, in which a highest silver iodide containing phase has a silver iodide content of not less than 5 mol % and less than 15 mol %, and a lower silver iodide containing phase is present outside and contiguous to the highest silver iodide containing phase; said tabular grains having 5 or more dislocation lines per grain and accounting for not less than 30% by number of total silver halide grains, said tabular grains further having a hole trap zone wholly within the grain and wherein said tabular silver halide grains are internally reduction-sensitized.

2. The silver halide emulsion of claim 1, wherein said highest silver iodide containing phase has a silver iodide content of not less than 5 mol % and less than 8 mol %.

3. The silver halide emulsion of claim 1, wherein said tabular grains comprise silver iodobromide or silver iodochlorobromide, each having an average silver iodide content of 1 to 15 mol %.

4. A silver halide photographic emulsion comprising tabular silver halide grains each comprising plural silver halide phases different in a silver iodide content from each other, in which a highest silver iodide containing phase has a silver iodide content of not less than 5 mol % and less than 15 mol %, and a lower silver iodide containing phase is present outside and contiguous to the highest silver iodide containing phase; said tabular grains having 5 or more dislocation lines per grain, accounting for not less than 30% by number of total silver halide grains and having a hole trap zone wholly within the grain; and said tabular grains being prepared by a process comprising the steps of (i) forming seed grains, (ii) ripening the seed grains formed, and (iii) growing the seed grains to form tabular grains.

5. The silver halide emulsion of claim 4, wherein, in step (ii), reduction sensitization is carried out by ripening the seed grains at a pAg of 7.0 or less or at a pH of 7.0 or more.

6. The silver halide emulsion of claim 5, wherein, at a time during step (iii), an iodide salt is introduced at a pAg of not more than 11.0 without addition of a halide salt other than the iodide.

7. The silver halide emulsion of claim 6, wherein said iodide is introduced in the form of silver iodide fine grains.

8. The silver halide emulsion of claim 6, wherein said iodide is introduced at a time between after 50% of the total silver salt is added and before 95% of the total silver salt is added.

9. The silver halide emulsion of claim 4, wherein, in step (iii), reduction sensitization is carried out by adding a reducing agent or ripening at a pAg of 7.0 or less or at a pH of 7.0 or more.

10. The silver halide emulsion of claim 9, wherein the reduction sensitization is carried out at a time before 70% of the ultimate grain volume of the grain is reached.

11. The silver halide emulsion of claim 4, wherein, in step (iii), grain growth is carried out in the presence of an oxidizing agent.

12. The silver halide emulsion of claim 11, wherein said oxidizing agent is a compound represented by the following formula (I), (II) or (III), $$R—SO_2S—M \quad (I)$$

$$R—SO_2S—R_1 \quad (II)$$

$$R—SO_2S—L_m—SSO_2—R_2 \quad (III)$$

wherein R, $R_1$ and $R_2$ independently represent an aliphatic group, aromatic group or heterocyclic group; M represents a cation; L represents a bivalent linkage group; and m is 0 or 1.

13. A silver halide photographic light sensitive material comprising a support having thereon a silver halide emulsion layer, wherein said silver halide emulsion layer contains the silver halide emulsion as claimed in claim 1.

* * * * *